United States Patent [19]

McLeod

[11] Patent Number: 4,993,488

[45] Date of Patent: Feb. 19, 1991

[54] WELL CASING PACKERS

[76] Inventor: Roderick D. McLeod, 5104-125 Street, Edmonton, Alberta, Canada, T6H 3V5

[21] Appl. No.: 430,012

[22] Filed: Nov. 1, 1989

[30] Foreign Application Priority Data

Nov. 2, 1988 [CA] Canada ..... 581963

[51] Int. Cl.[5] ..... E21B 33/03

[52] U.S. Cl. ..... 166/72; 166/80; 166/90; 166/196

[58] Field of Search ..... 166/70, 72, 73, 80, 166/85, 90, 77, 75.1, 196, 179, 192; 73/49.6, 49.5, 40.5 R, 46, 49.1

[56] References Cited

U.S. PATENT DOCUMENTS

| | | | |
|---|---|---|---|
| 2,056,543 | 10/1936 | Tschappat | 166/80 |
| 2,475,748 | 7/1949 | Leroy | 73/46 X |
| 3,366,181 | 1/1968 | McCall | 166/72 |
| 3,830,304 | 8/1974 | Cummins | 166/80 X |
| 4,023,814 | 5/1977 | Pitts | 166/90 X |
| 4,241,786 | 12/1980 | Bullen | 166/77 |
| 4,452,304 | 5/1984 | Barrier et al. | 166/70 |
| 4,632,183 | 12/1986 | McLeod | 166/77 |
| 4,657,075 | 4/1987 | McLeod | 166/72 |
| 4,691,770 | 9/1987 | McLeod | 166/73 |
| 4,867,243 | 9/1989 | Garner et al. | 166/77 X |

FOREIGN PATENT DOCUMENTS

| | | | |
|---|---|---|---|
| 1323169 | 8/1987 | U.S.S.R. | 73/49.1 |

*Primary Examiner*—Hoang C. Dang

*Attorney, Agent, or Firm*—Stevens, Davis, Miller & Mosher

[57] ABSTRACT

An expanding nipple, externally mounted packer has a body which mounts onto a stack of blowout preventers or a casing head and tubing spool or the like. The body contains an external locking mechanism and the upper ends of a pair of concentric mandrels which are lowered into the well casing, through the blowout preventer stack or other configuration of well head equipment. The outer mandrel has a deformable seal on its lower end and the inner mandrel has an expander on its lower end. A piston on the inner mandrel responsive to hydraulic pressure, raises the inner mandrel with respect to the outer mandrel so that the expander forces the seal outwards against the casing wall. The locking mechanism allows the seal to be locked in place. The hydraulic pressure on the piston is reversed to unseal the nipple.

2 Claims, 3 Drawing Sheets

WELL CASING PACKERS

FIELD OF THE INVENTION

This invention relates to oil and gas well servicing and specifically to an apparatus for sealing off a spool, blowout preventer or other wellhead annulus when servicing the well.

BACKGROUND OF THE INVENTION

During the servicing of oil and gas wells it is often necessary to pump fluids and slurries down the well at pressures that are greater than the ratings of the associated well head equipment such as valves, blowout preventers, hangars spools etc. The wellhead isolation tool or tree saver was developed for the purpose of pumping under pressure through wellhead valves and down the tubing. Tree savers work on wells that are dead or under pressure and which have tubing in them. There are, however, a large numbers of wells that must be serviced which do not have tubing in them and the servicing must be done down the casing. For wells which are under pressure, a tool called a casing saver is used. For wells which will not be under pressure at the beginning or end of the servicing, a much simpler and less expensive method of protecting the wellhead configuration is to use a well casing packer.

Conventionally, the method of servicing down well casing has been to use what is known as a downhole packer. The purpose of the packer is to pump the fluid or slurry down the long string casing without the fluid having access to the various wellhead configurations mounted on top of the well.

To accomplish this, a packer is lowered into the long string casing on tubing using a service rig such as a Franks 100. The packer is then set by either tension or compression and by turning the tubing. The tubing at the top is then set up so that fluid can be pumped downwardly through the tubing, through the packer and into the lower part of the long string casing. The packer and service rig may be of any of several available makes.

Those skilled in the art will appreciate the fact that pumping fluid down one thousand feet of tubing takes much more power than to pump the fluid down the casing only. Also, testing to make sure that the packer is set entails pumping fluid down the annulus and then taking the pressure up to see if the packer may leak. There is a significant percentage of packer failure in this type of service and pulling out and re-running the packer is very time consuming and expensive.

A recent advance in packer technology has been the top mounted packer, a small packing system which mounts on the top of the wall in the casing. The existing equipment has the problems of not having any visible way of telling if the seal has been set, and of being very difficult to unseat after use.

SUMMARY OF THE INVENTION

The present invention provides a significant improvement in the art of well casing packers in providing apparatus that can be put in place by a small hoist truck and be set and released with the aid of a small hand operated hydraulic pump at the wellhead rather than by a large service rig. Testing to see if the seal has been properly set can be done visually and by pumping in a small amount of fluid into the annulus. During treatment, the looking mechanism can be observed and if the seal is failing, adjustments can be made without removing the packer.

According to a broad aspect, the invention relates to a short coupled well casing packer which comprises a body that is adapted for external mounting on a blowout preventer, casing head or other wellhead apparatus. A pair of concentric mandrels are supported in the body of the apparatus, the inner mandrel being movable axial with respect to the outer mandrel. Sealing means is provided on the lower end of the outer mandrel for circumferentially sealing against the inner wall of a well casing and means are provided on the lower end of the inner mandrel for engaging and expanding the seal. The body includes hydraulic pressure responsive piston means which is secured to the upper end of the inner mandrel for linearly moving the inner mandrel with respect to the outer mandrel in both the up and down directions, such hydraulic means being isolated from the well servicing fluids, and an external visible means for locking the inner mandrel in position relative to the outer mandrel, such locking means operable external for the packer.

BRIEF DESCRIPTION OF THE DRAWINGS

The invention is illustrated by way of example only in the accompanying drawings in which.

DESCRIPTION OF THE PREFERRED EMBODIMENT

Figure 1:
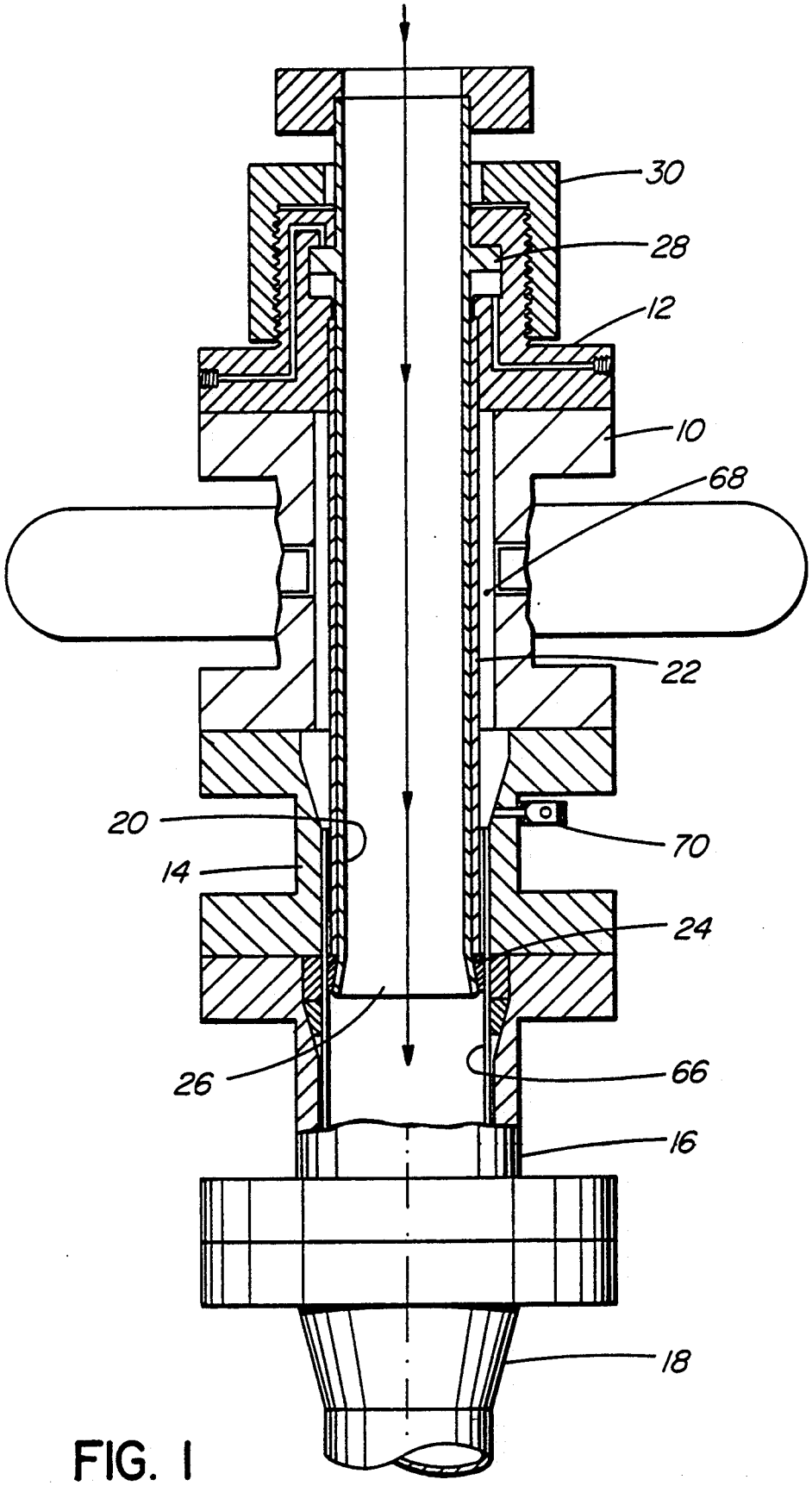
FIG. 1 is a cross sectional schematic view of the invention installed on a wellhead through a blowout preventer and spool.

Referring to FIG. 1, the packer is illustrated generally on the blowout preventer 10. The packer includes a steel body 12 which is externally mounted by suitable bolts, not shown, to the upper end of a blowout preventer and associated wellhead equipment, a casing hanger 14 and a casing head 16. Concentric inner and outer mandrels 20, 22 respectively are supported in the steel body 12 by means to be described and the inner mandrel 20 is axially movable with respect to the outer mandrel 22. A pack off seal 24 is provided on the lower end of the outer mandrel 22 and an expander nipple 26 is provided on the lower end of the inner mandrel 20. As will be subsequently described, pressure responsive means in the form of a piston 28 which is secured adjacent to the upper end of the inner mandrel 20 linearly moves the inner mandrel upwardly with respect to the outer mandrel in response to hydraulic pressure fed to the underside of the piston 28 so that the expander nipple 26 will apply upward and outward pressure against the packoff seal 24 and thereby seal off the upper end of the casing. An external lock nut 30 is provided for locking the inner mandrel in position relative to the outer mandrel. To unseat the packoff seal, the lock nut 30 is disengaged from the inner mandrel and hydraulic pressure is fed onto the top side of the piston 28 forcing the inner mandrel and its associated expander nipple 26 downward, thus releasing the pressure on the packoff seal 24.

Figure 2:
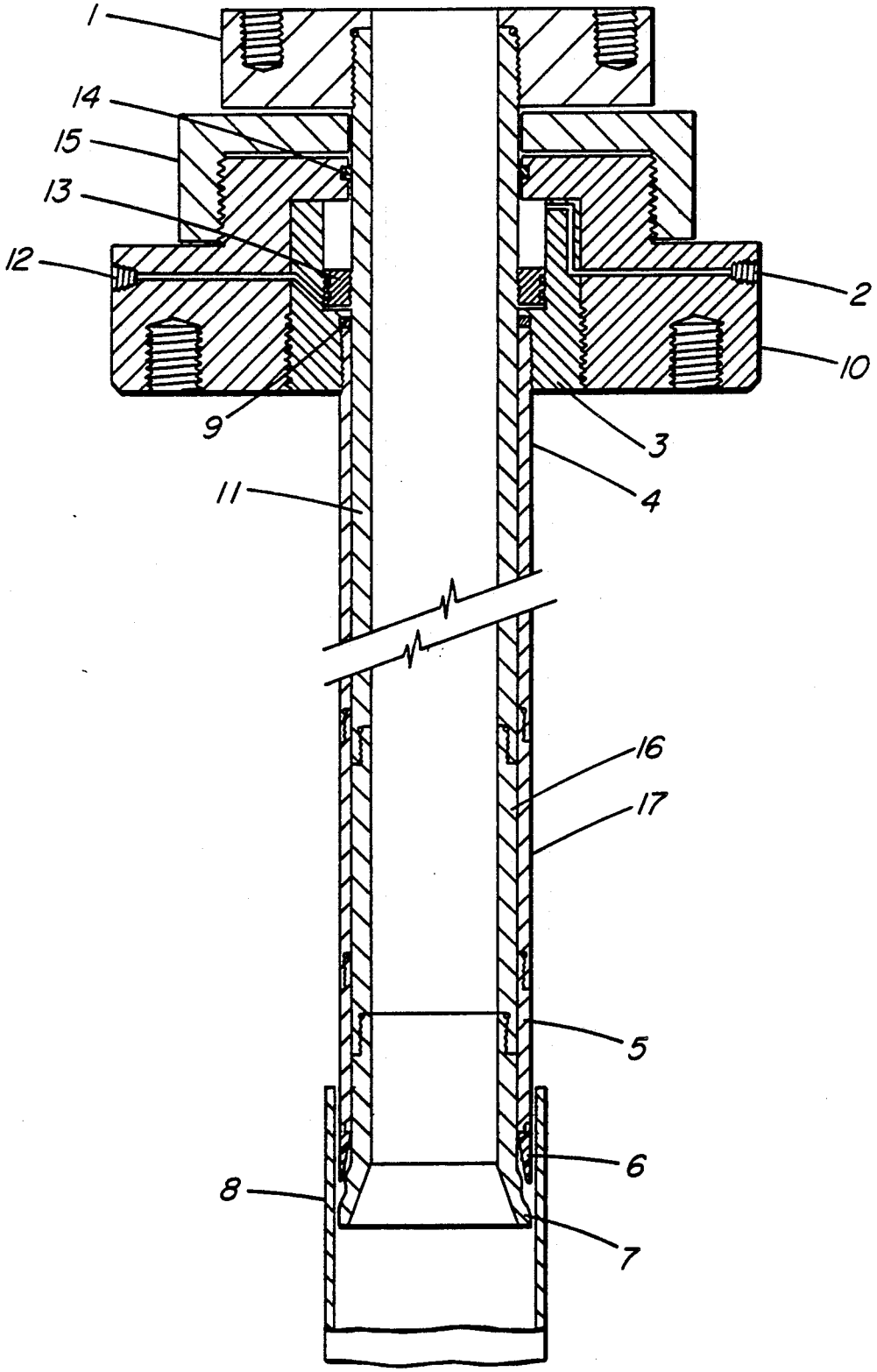
FIG. 2 is a cross sectional view in greater detail of the present invention in an unset or running position; and, FIG. 3 is a view similar to FIG. 1 but shows the apparatus in the set position.

Turning now to FIG. 2, the body 10 has a central sealed cavity defined by the body 10, the threaded cylinder insert 3 and the seal 14. The outer mandrel 4 threads into the cylinder insert 3 and has attached to it at its lower end, outer mandrel extension 17, nipple 5 and rubber packoff seal 6. The extension noted are for different well head configurations. The sealed cavity is fed with hydraulic fluid through the two oil ports 2 and 12. The piston 13 is threadably attached to the inner mandrel 11 as is the connecting flange 1. The inner mandrel 11 also has inner mandrel extension 16 and expander nipple 7 on its lower end. The locking nut 15 is threadably held on the body 10 and can be turned to move in an upward direction and engage the connecting flange 1 as shown in FIG. 3.

Figure 3:
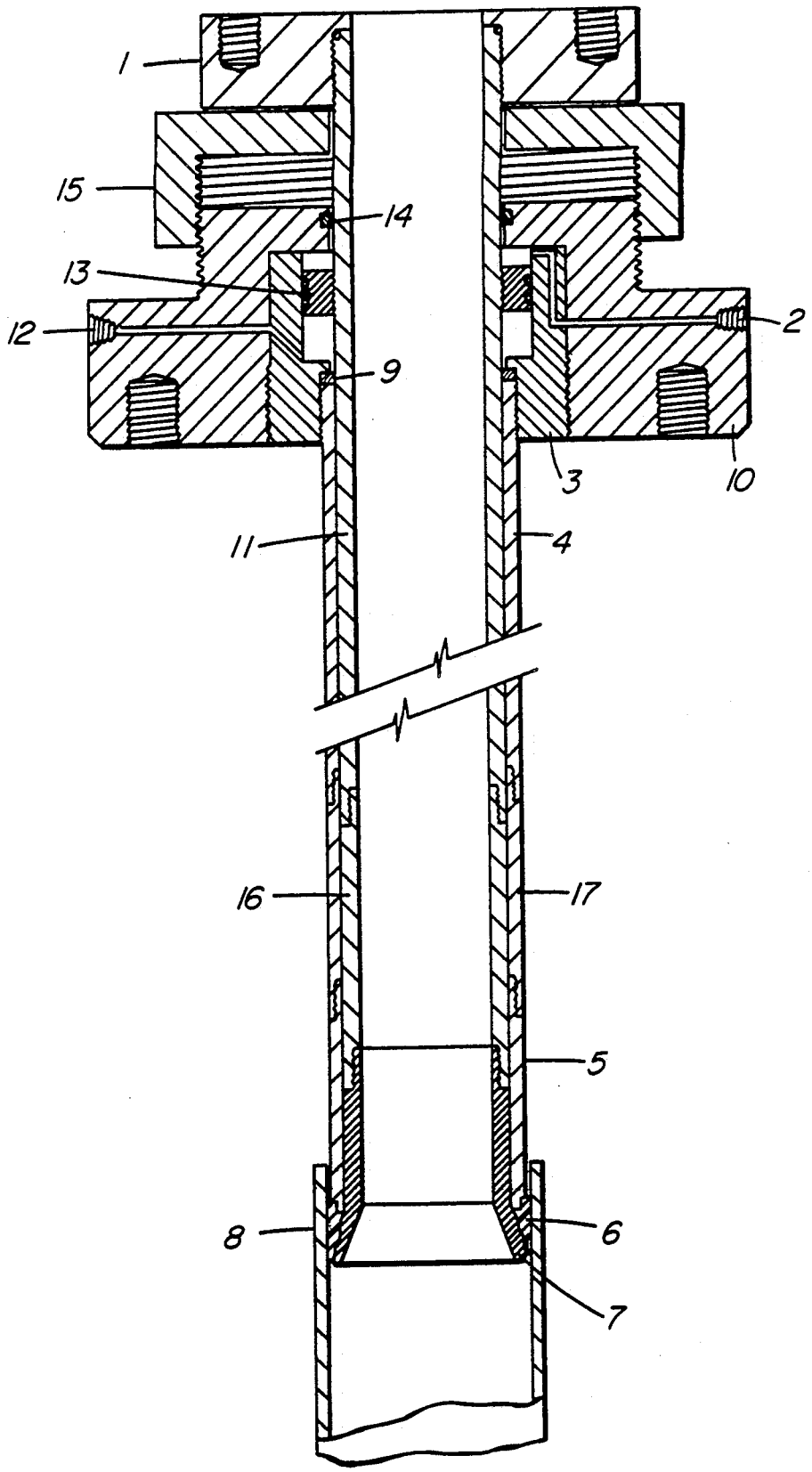

Turning now to FIG. 3, in response to fluid being fed into the bottom side of the piston 13 through the port 12, and at the same time fluid is allowed to release from the top side of the piston 13 through the port 2, the inner mandrel 11 raises the expander 7 which applies an upward and outward pressure on the sealing rubber 6 so this seal firmly engages the inner wall of the well casing 8. The looking nut 15 is now turned in a direction to move it upwards on the threads off the body 10, and it is forced to engage the bottom of the connecting flange 1. The ports 2, 12 are sealed, and the packer is now locked both mechanically and hydraulically in the set position. It can be seen that any fluids passing through the connecting flange 1 and the inner mandrel 11, inner mandrel extension 16 and expander 7, will go straight through into the casing 8 without any effect on any valves etc. on the wellhead.

It will be realized that monitoring the hydraulic pressure at the port 12 when setting the tool will allow the pressure of the sealing rubber 6 to be known. It will also be noted that a measurement taken at the lock nut before and after setting will allow confirmation of of the setting. The seal may now be tested by pumping a small amount of fluid into an annular valve 70 as shown in FIG. 1. This will fill the annulus 68 shown and allow pressure to be put against the back of the seal at 24.

To release the packer, the look nut is first backed away from the connecting flange 1. Ports 2 and 12 are opened, and fluid is fed into port 2. This forces the piston 13 and the inner mandrel 11 and its associated parts in the downward direction, thus disengaging the expander 7 from the sealing rubber 6. When the piston has moved to the bottom of the stroke, the seal will have been broken and as there will be no pressure in the well, the packer may now be taken off.

Those skilled in the art will appreciate that various features, characteristics and advantages of the present invention have been set forth herein or are readily realizable from the detailed description of the preferred embodiment. However, the disclosure is illustrative and various changes may be made while utilizing the principles of the present invention and falling within the scope of the invention as expressed in the appended claims.

The embodiments of the invention in which an exclusive property or privilege is claimed are defined as follows:

1. A short-coupled, well casing packer comprising:
   (a) a body adapted for external mounting on a well casing head, tubing spool or the like;
   (b) concentrically arranged inner and outer mandrels supported in said body, each outer mandrel being adapted to be restrained to the casing head and said inner mandrel being axially moveable within said outer mandrel, the upper end of said inner mandrel extending upwardly and outwardly of said body and having a connecting flange;
   (c) high pressure seal means on the lower end of said outer mandrel for circumferentially sealing the lower end of said outer mandrel against the inner wall of said casing;
   (d) seal expanding means on the lower end of said inner mandrel for circumferentially engaging and radially expanding said seal means;
   (e) hydraulic pressure responsive piston means in said body and secured to said inner mandrel for linearly moving said inner mandrel upwardly or downwardly with respect to said outer mandrel; and
   (f) means engaging the upper end of said inner mandrel for locking said inner mandrel in position relative to said outer mandrel, comprising a lock nut having a peripheral rim portion threadably engaging the outside of said body and a planar collar portion, normal to said rim portion, and being disposed intermediate the upper end of said body and the under-surface of said connecting flange; whereby, when said inner mandrel is moved upwardly by said piston means, the distance of said movement will be indicated by the commensurate space between the lower surface of said connecting flange and the upper surface of said planar collar portion.

2. Apparatus according to claim 1 including a peripheral fluid-tight cavity in said body and extending circumferentially about a portion of said inner mandrel, said piston means being located for vertical movement in said cavity, and hydraulic port means in said body extending from the exterior of said body to the upper and lower ends of said cavity for applying fluid under pressure to either side of said piston means.

* * * * *